US005667377A

United States Patent [19]

Lin

[11] Patent Number: 5,667,377

[45] Date of Patent: Sep. 16, 1997

[54] GAS TORCH

[76] Inventor: Arlo H. T. Lin, No. 5, Lane 25, Tatung Rd., Wu Fong Hsiang, Taichung Hsien, Taiwan

[21] Appl. No.: 499,755

[22] Filed: Jul. 7, 1995

[51] Int. Cl.[6] ..... F23Q 2/00

[52] U.S. Cl. ..... 431/344; 431/255; 126/406

[58] Field of Search ..... 431/254, 255, 431/256, 344, 153; 126/406

[56] References Cited

U.S. PATENT DOCUMENTS

| | | | |
|---|---|---|---|
| 3,667,895 | 6/1972 | Ross | 431/255 |
| 4,069,006 | 1/1978 | Jackson | 431/344 |
| 4,348,172 | 9/1982 | Miller | 431/255 |
| 4,432,542 | 2/1984 | Poynter | 431/254 |
| 4,502,465 | 3/1985 | Yoshinaga et al. | 431/255 |
| 4,919,111 | 4/1990 | Ohsawa | 431/256 X |
| 5,082,440 | 1/1992 | Yamamoto | 431/255 |

*Primary Examiner*—Carl D. Price
*Attorney, Agent, or Firm*—Pro-Techtor International

[57] ABSTRACT

A gas torch including a butane container having a top side mounted with a flame adjustment wheel and a gas lever and a holder frame, the holder frame having two outward mounting flanges at two opposite sides respectively secured to the top side of the butane container and holding a flame tube on the outside and an electronic igniter on the inside, a control button mounted on the holder frame above the top side of the butane container and depressed to trigger the electronic igniter, the control button having a backward extension frame, an actuating strip mounted on the backward extension frame of the control button and moved to lift the gas lever in releasing fuel gas from the butane container, and a transverse control bar mounted in the outward mounting flanges of the holder frame and controlled to hold the control button and the actuating strip in the depressed position or to force them back to stop fuel gas.

5 Claims, 7 Drawing Sheets

GAS TORCH

BACKGROUND OF THE INVENTION

The present invention relates to gas torches, and relates more particularly to an improved structure of gas torch which can be conveniently operated with one hand.

Various palm-top gas torches have been disclosed for use in welding things, and have appeared on the market. Regular gas torches commonly use a ignition switch to control the ignition of the electronic igniter, and a rotary knob to control the flowrate of fuel gas. During the operation, the ignition switch and the rotary know must be operated with both hands. Regulating the flowrate of fuel gas through the rotary knob is still not very convenient. There is known a gas torch which uses a stop control knob controlled to stop fuel gas. However, the stop control knob is inconvenient to operate because it is disposed at the back side opposite to the flame tube. This arrangement does not allow the operator to conveniently operate the gas torch with one hand.

SUMMARY OF THE INVENTION

The present invention has been accomplished to provide a gas torch which eliminates the aforesaid drawbacks. According to the preferred embodiment of the present invention, the gas torch comprises a butane container having a top side mounted with a flame adjustment wheel and a gas lever and a holder frame, the holder frame having two outward mounting flanges at two opposite sides respectively secured to the top side of the butane container and holding a flame tube on the outside and an electronic igniter on the inside, a control button mounted on the holder frame above the top side of the butane container and depressed to trigger the electronic igniter, the control button comprising a backward extension frame, an actuating strip mounted on the backward extension frame and moved to lift the gas lever in releasing fuel gas from the butane container.

According to another aspect of the present invention, a transverse control bar is mounted in the outward mounting flanges of the holder frame and controlled to hold the control button and the actuating strip in the depressed position or to force them back to stop fuel gas.

DETAILED DESCRIPTION OF TEE PREFERRED EMBODIMENT

Figure 1:
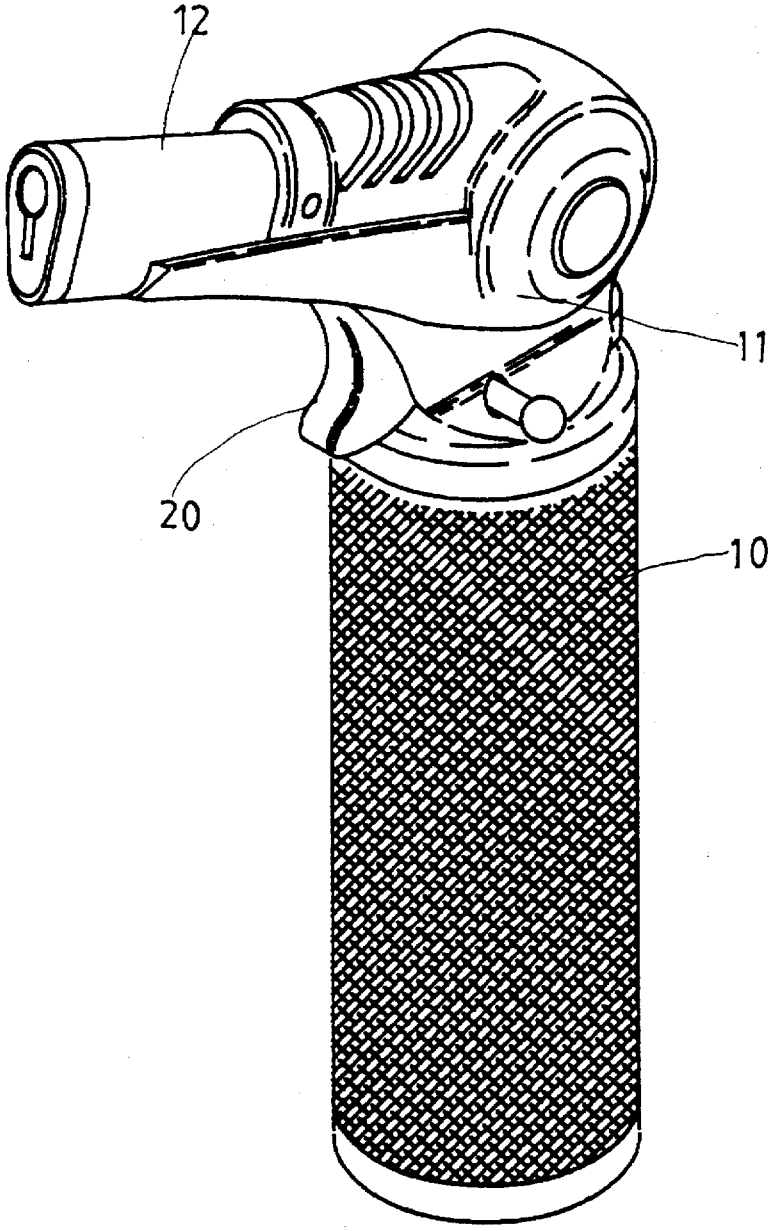
FIG. 1 is an elevational view of a gas torch according to the present invention.

Referring to FIG. 1, a gas torch in accordance with the present invention is shown comprised of a cylindrical fuel gas (generally butane) container 10 in proper height and diameter, a guard shell 11 mounted on the top side of the butane container 10 to protect inside control elements, a flame tube 12 extended out of the guard shell 11, and a control button 20 at the bottom side of the flame tube 12.

Figure 2:
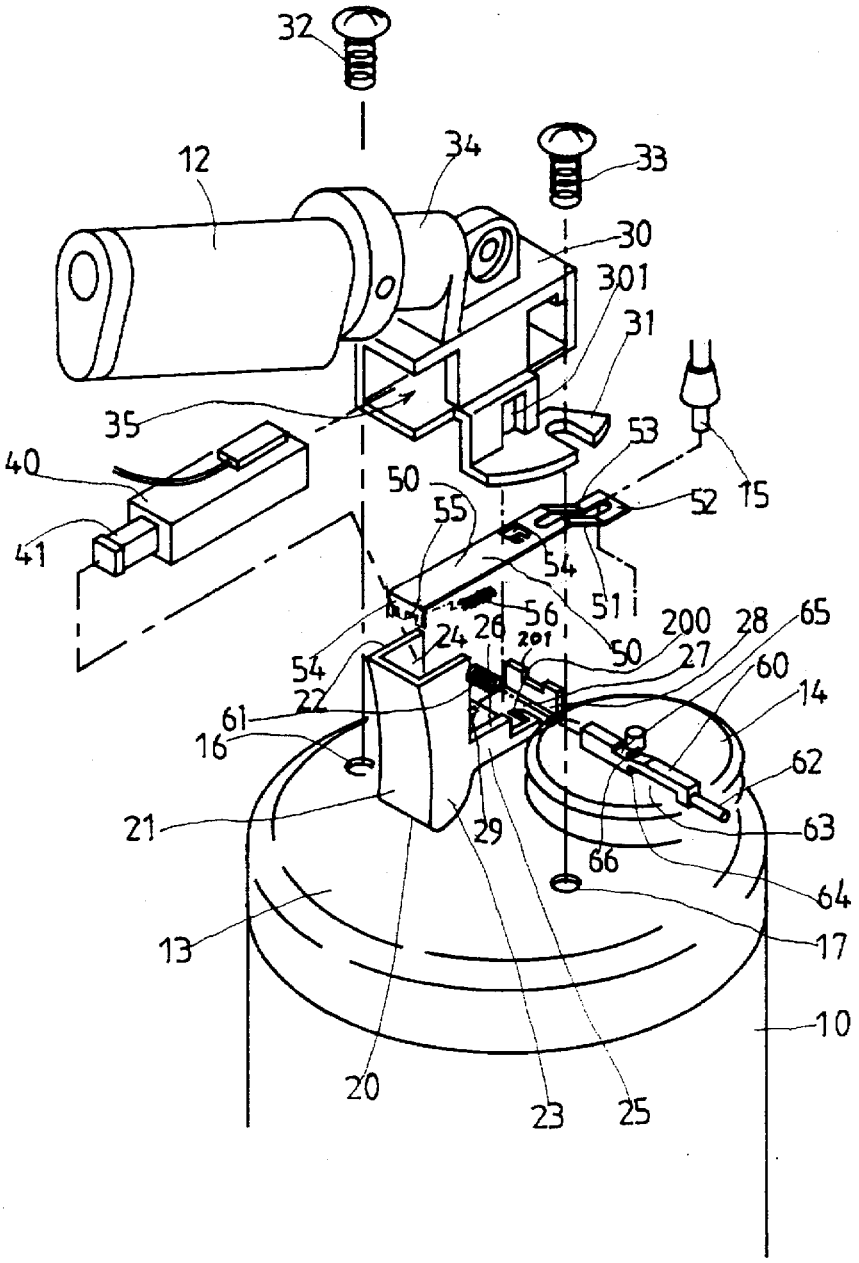
FIG. 2 is an exploded view of the gas torch shown in FIG. 1 when the guard shell removed.

Referring to FIG. 2, a flame adjustment wheel 14 is mounted on the top side 13 of the butane container 13, and a gas lever 15 is connected to the flame adjustment wheel 14 at the top. A holder frame 30 is provided having two outward mounting flanges 31 at two opposite sides respectively fastened to respective screw holes 16 and 17 by respective screws 32 and 33. The holder frame 30 further comprises an oblique barrel 34 at the top, which holds the aforesaid flame tube 12, a bottom chamber 35, which holds an electronic igniter 40. The electronic igniter 40 comprises an ignition switch lever 41 extended out of the holder frame 30. The aforesaid control button 20 comprises a front wall 21, two opposite side walls 22 and 23 perpendicularly backwardly extended from the front wall 21, a back chamber 24 defined within the front wall 21 and the opposite side walls 22 and 23, which back chamber 24 receives the ignition switch lever 41, and a backward extension frame 25 mounted at the bottom of the holder frame 30. The backward extension frame 25 comprises a first hollow step 26, a second hollow step 27, an upright tail 28, a rod 29 in the first hollow step 26, a transverse rib 200 in the second hollow step 27 defining with the first hollow step 26 and the upright tail 28 a respective sliding way, and a top notch 201 on the upright tail 28. An actuating strip 50 is disposed above the backward extension frame 25, having a front end terminating in a downward bend 54, and an opposite end terminating in a slope 51 and then a horizontal tip 52. The slope 51 has a longitudinal hole 53, which receives the gas lever 15. The actuating strip 50 further comprises a downward tongue 54 adjacent to the slope 51, and a projecting portion 55 raised from the downward bend 54. A spring 56 is connected between the projecting portion 55 of the actuating strip 50 and the rod 29 in the first hollow step 26 of the backward extension frame 25. A transverse control bar 60 is mounted on the backward extension frame 25 of the control button 20 between the transverse rib 200 and the upright tail 28. A spring 61 is mounted in a hole 300 on one outward mounting flange 31 of the holder frame 30 and stopped against the transverse control bar 60 (see FIG. 4). The transverse control bar 60 has one end one stopped against the spring 61, and an opposite end terminating in a press rod 62 which extends out of a hole 301 on the opposite outward mounting flange 31 of the holder frame 30. The transverse control bar 60 further comprises a bottom recess 63 defining a stop edge 64, a top recess 65, and an upright rib 66 raised from the top recess 65.

Figure 4:
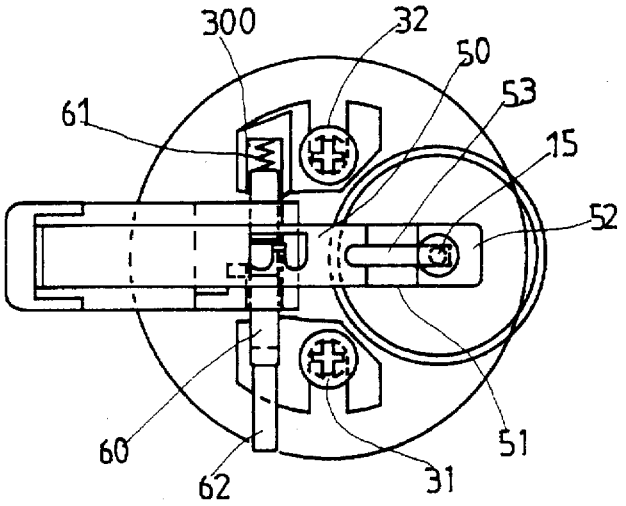
FIG. 4 is a top view of FIG. 3.
Figure 3:
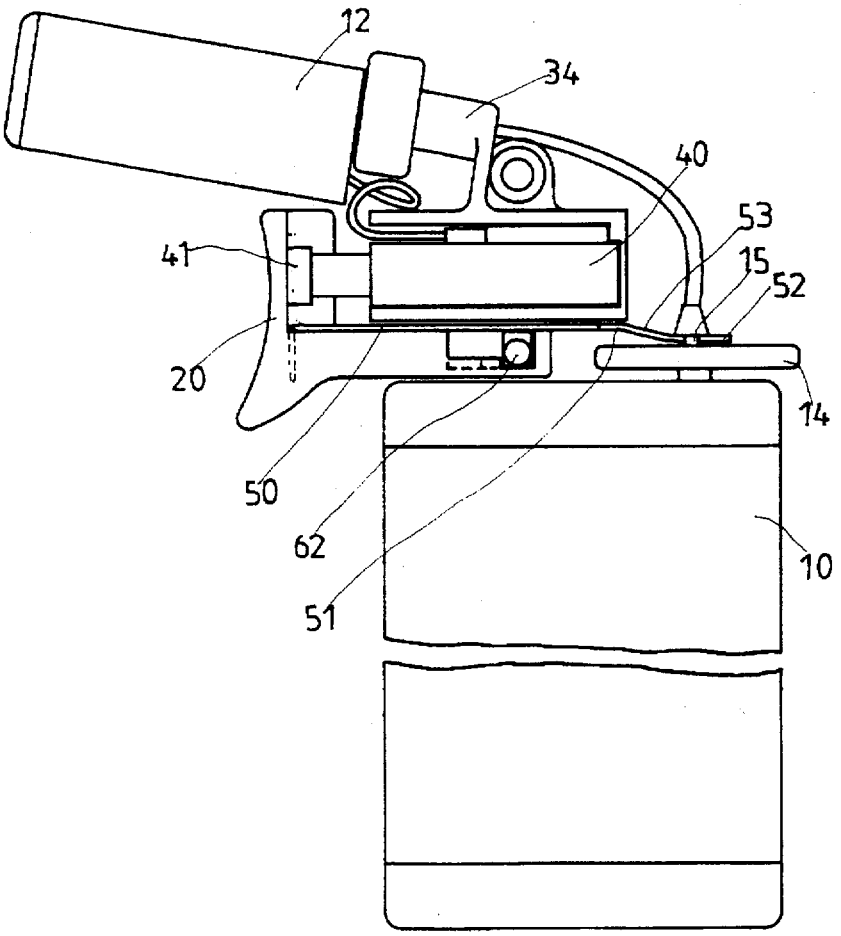
FIG. 3 is a front assembly view of FIG. 2.
Figure 6:
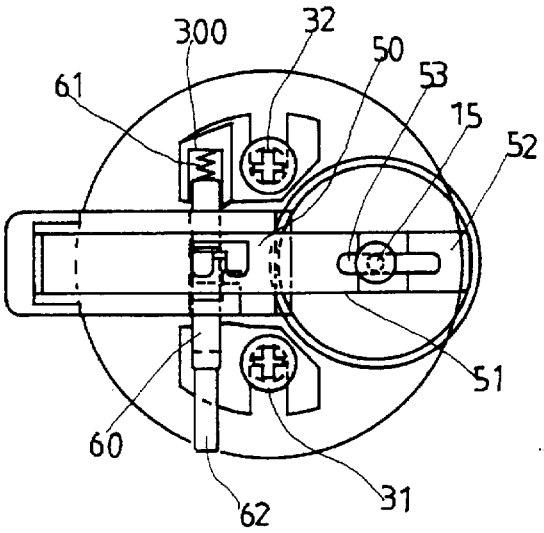
FIG. 6 is a top view of FIG. 5.
Figure 5:
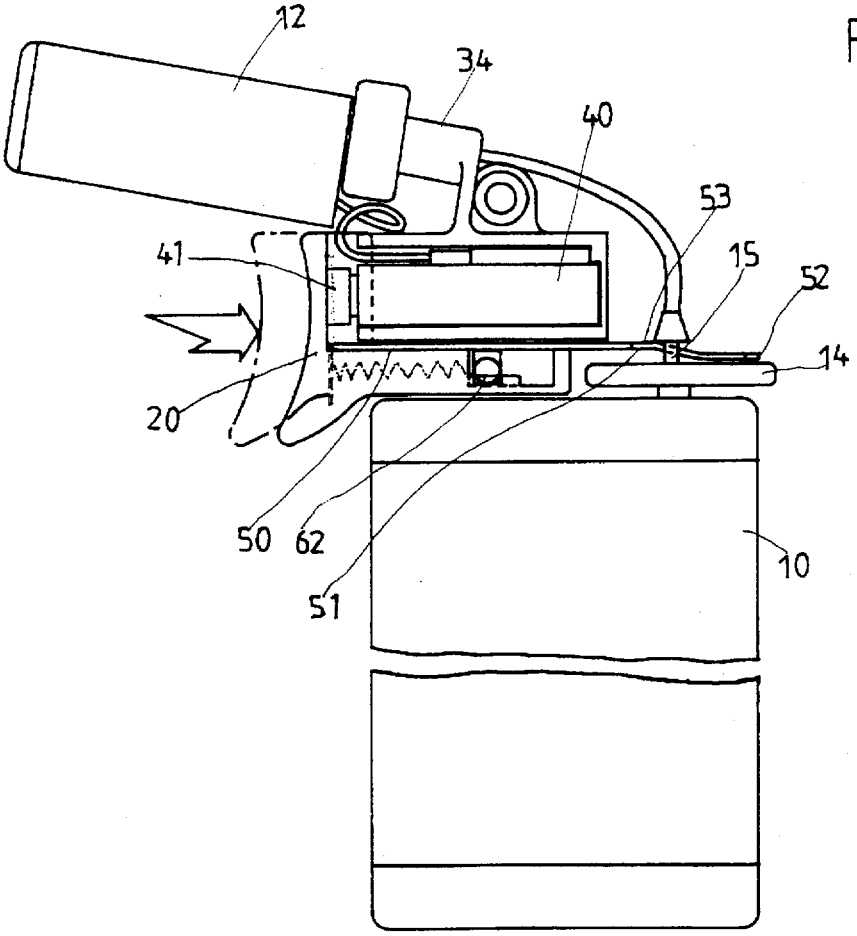
FIG. 5 is similar to FIG. 3 but showing the control button depressed.
Figure 7:
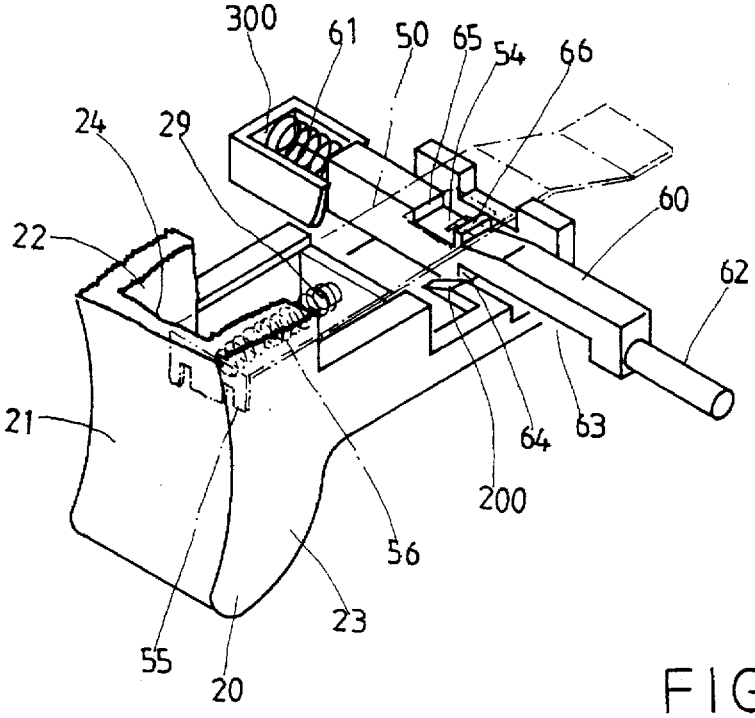
FIG. 7 shows the transverse control bar installed in the backward extension frame of the control button according to the present invention.
Figure 8:
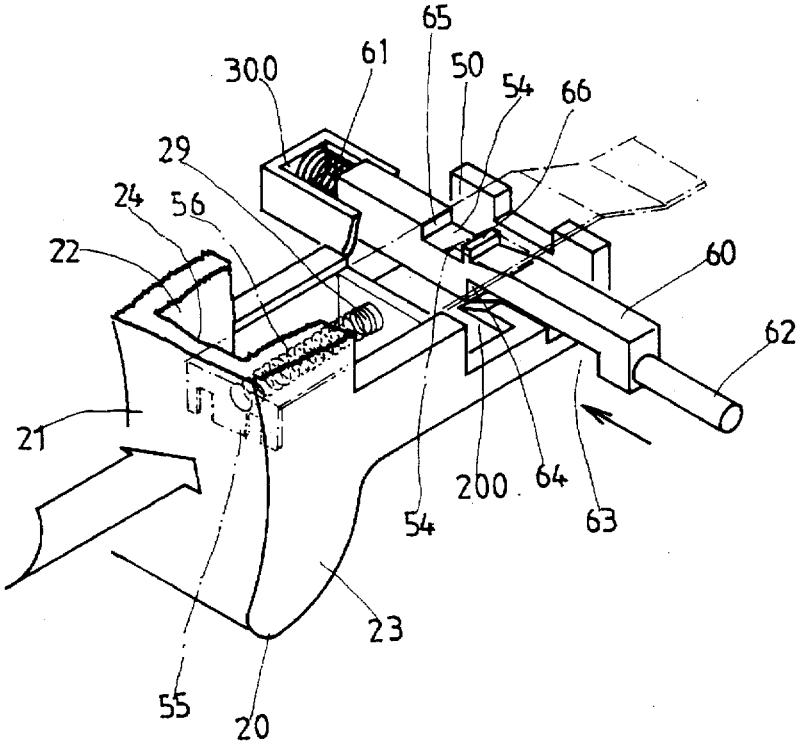
FIG. 8 is similar to FIG. 7 but showing the transverse control bar depressed.
Figure 9:
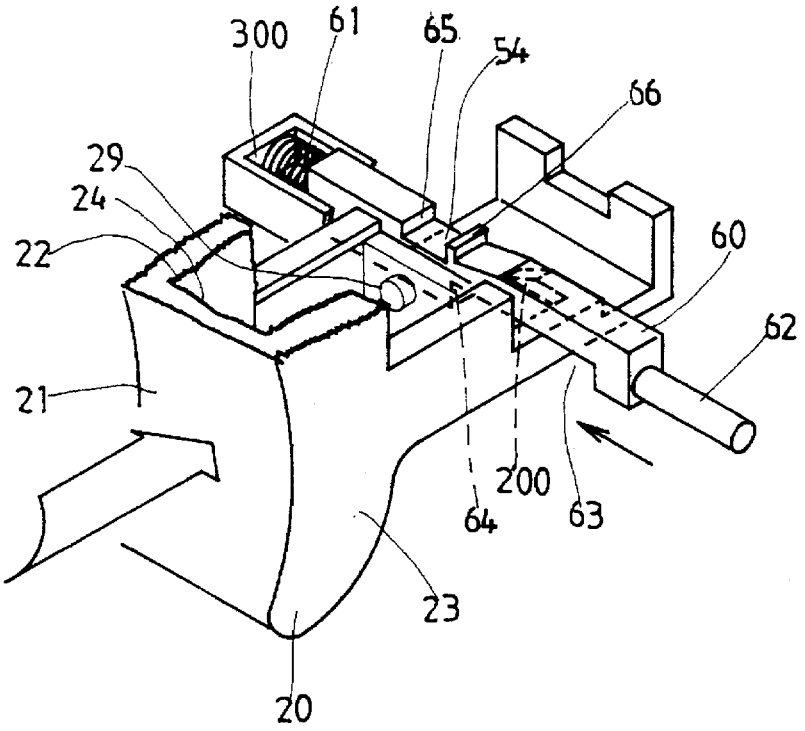
FIG. 9 is similar to FIG. 8 but showing the transverse control bar shifted to the sliding way between the transverse rib and the first hollow step.
Figure 10:
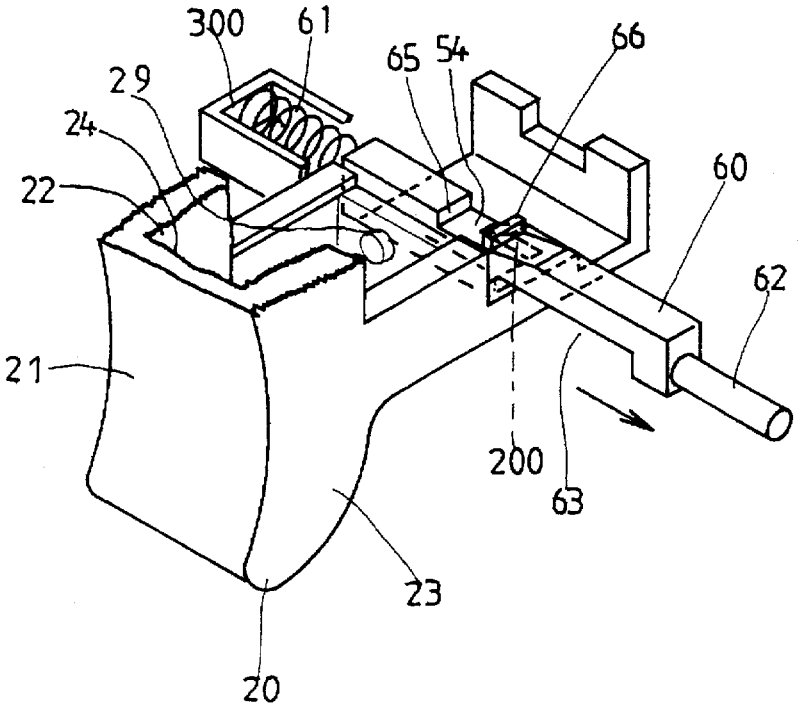
FIG. 10 shows the transverse control bar released.

Referring to FIGS. 4, 5, and 6, when the control button 20 is depressed, the ignition switch lever 41 of the electronic igniter 40 is depressed, causing the electronic igniter 40 to produce sparks. At the same time, the actuating strip 50 is moved rightward by the control button 20 to force the gas lever 15 upwards along the longitudinal hole 53, causing the butane container 10 to release fuel gas for burning by the sparks.

Referring to FIGS. 7, 8, 9, and 10, when the transverse control bar 60 is depressed, the upright rib 66 is forced against the downward tongue 54 of the actuating strip 50, causing the downward tongue 54 turned upward for letting the upright rib 66 to pass. When the upright rib 66 passes over the downward tongue 54, it becomes stopped by the downward tongue 54, and at the same time the spring 61 is compressed. When the control button 20 is depressed again, the transverse control bar 60 is shifted from the sliding way between the transverse rib 200 and the upright tail 28 to the sliding way between the transverse rib 200 and the first hollow step 26 (see FIG. 9). When the transverse control bar 60 is released from the hand, the spring 61 forces the transverse control bar 60 outwards (see FIG. 10). At this stage, the control button 20 and the actuating strip 50 are retained in position, and a fixed volume of fuel gas is released from the butane container 10.

Figure 11:
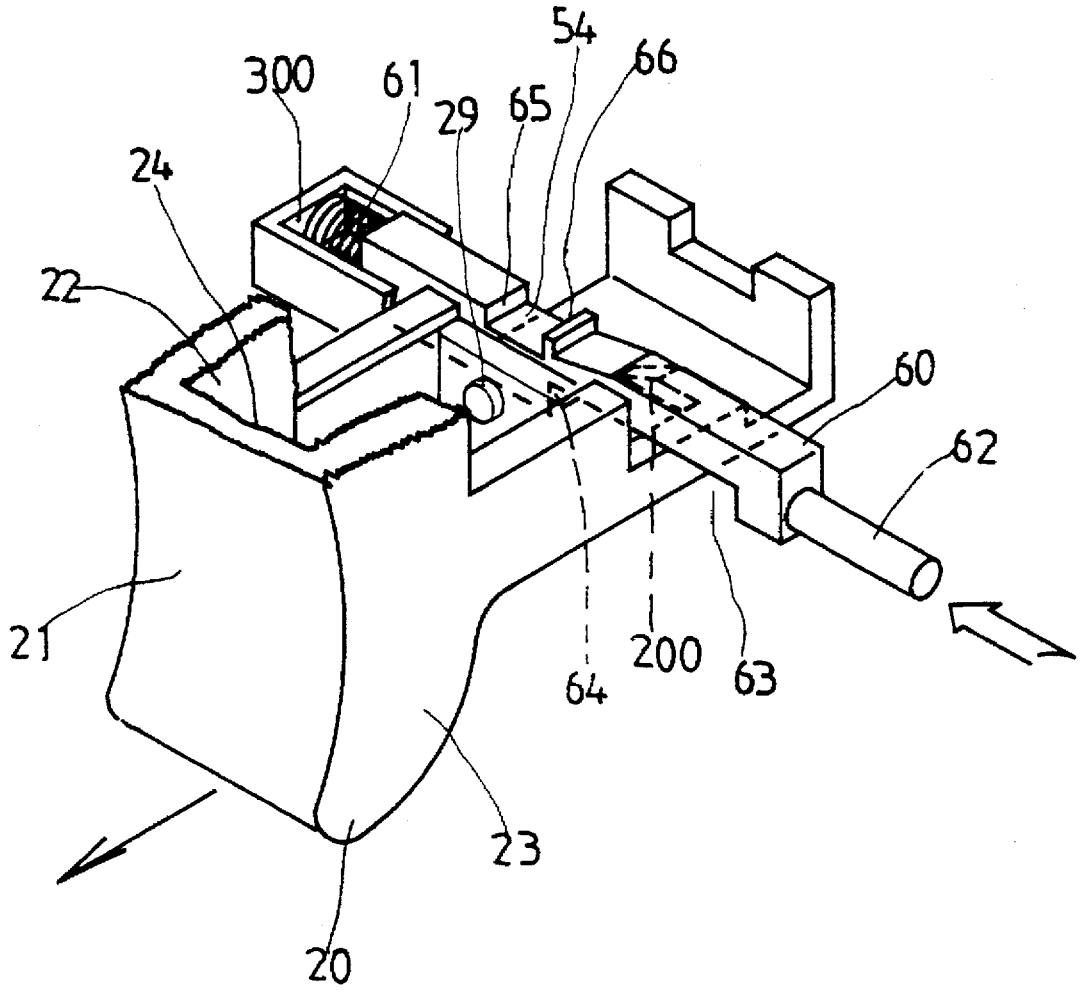
FIG. 11 shows the transverse control bar depressed again, and the control button moved back to its former position.

Referring to FIG. 11, when the transverse control bar 60 is depressed again, the control button 20 and the actuating strip 50 are forced back to their former positions by means of the effect of the springs 56 and 61, causing the gas lever 15 moved downward along the longitudinal hole 53, and therefore fuel gas is stopped.

Because the control button 20 is disposed at the bottom of the flame tube 12, the control button 20 can be operated with the forefinger, the flame adjustment wheel 14 can be operated with the thumb. Furthermore, the installation of the transverse control bar 60 can be conveniently operated to stop fuel gas.

It is to be understood that the drawings are designed for purposes of illustration only, and are not intended as a definition of the limits and scope of the invention disclosed.

I claim:

1. A gas torch comprising:

a fuel gas container with a flame adjustment wheel that controls a flow rate of fuel through a valve on said fuel gas container, a gas lever that is raised to allow fuel to flow through a tubular portion of said lever to an oblique barrel and then to a flame tube connected to said barrel, said gas lever is lowered to stop fuel from flowing through said tubular portion, and a holder frame;

said holder frame has two flanges on opposing sides thereof and is mounted on a top side of said fuel gas container via said flanges, and a flame tube mounted on said holder frame;

an electronic igniter with a control button mounted on said holder frame of said fuel gas container, said igniter is activated by a user depressing said control button, said control button comprises a backward extension frame, said backward extension frame comprises a first hollow step, a second hollow step, an upright tail, a transverse rib disposed in said second hollow step and defining a first sliding way between said transverse rib and said upright tail, and a second sliding way between said transverse rib and said first hollow step;

an actuating strip mounted on said backward extension frame that actuates said gas lever to release fuel gas from said fuel gas container when said actuating strip is activated by a user depressing said control button, said control button moving said transverse control bar that is in communication with said actuating strip; and wherein when said transverse control bar is pressed from an outward position by the user to an inward position and said control button is then depressed by the user from an at-rest position to a depressed position, said extension frame of said control button moves under said control bar such that said control bar is moved from a first position in said first sliding way of said extension frame to a second position in said second sliding way of said extension frame, said control bar is then returned to said outward position by a force exerted by a compression spring contained in one of said flanges of said holder frame, said control bar thereby locking said control button and said actuating strip in position so as to maintain a constant flow of said fuel gas from said fuel container, and wherein said control button and said actuating strip are released by the user again depressing said control bar such that said control button returns to said at-rest position, thereby lowering said actuating strip to stop the flow of fuel gas.

2. The gas torch of claim 1 wherein:

said transverse control bar has a first end that contacts said compression spring in said holder frame and a bottom recess corresponding to said transverse rib, said transverse control bar being shifted between said first sliding way and said second sliding way when said control button is depressed.

3. The gas torch of claim 2 wherein:

said first end of said transverse control bar is inserted through a hole on a first one of said flanges on said holder frame into a hole on a second one of said flanges on said holder frame and contacts said compression spring, and a second end of said transverse control bar extends out of said holder frame and terminates in a press rod; said compression spring is mounted in said hole on said second flange of said holder frame and stopped against said transverse control bar.

4. The gas torch of claim 1 wherein:

said actuating strip has a bend at one end and a slope at an opposite end, said slope having a longitudinal hole which receives said gas lever, said actuating strip moves said gas lever between a closed position and an open position, said bend is connected to a rod in said first hollow step by a spring, said spring gives a forward pressure to said actuating strip, causing said actuating strip to urge said gas lever to said closed position.

5. The gas torch of claim 4 wherein:

said actuating strip further comprises a downward tongue that contacts an upright rib on said transverse control bar; said transverse control bar including an upright rib moved to effect said contact of said downward tongue of said actuating strip.

* * * * *